US010265638B2

(12) United States Patent
Apyshkov

(10) Patent No.: US 10,265,638 B2
(45) Date of Patent: Apr. 23, 2019

(54) THREE-DIMENSIONAL MAGNETIC CONSTRUCTION KIT-TOY

(71) Applicant: Volodymyr Gutnyk, Lewisville, TX (US)

(72) Inventor: Mykhaylo Apyshkov, Lewisville, TX (US)

( * ) Notice: Subject to any disclaimer, the term of this patent is extended or adjusted under 35 U.S.C. 154(b) by 0 days.

(21) Appl. No.: 15/461,410

(22) Filed: Mar. 16, 2017

(65) Prior Publication Data

US 2017/0266578 A1 Sep. 21, 2017

Related U.S. Application Data

(60) Provisional application No. 62/308,957, filed on Mar. 16, 2016.

(51) Int. Cl.
*A63H 33/04* (2006.01)
*A63H 33/26* (2006.01)

(52) U.S. Cl.
CPC ..... *A63H 33/046* (2013.01); *A63H 33/26* (2013.01)

(58) Field of Classification Search
CPC ..... A63H 33/046; A63H 33/26
USPC ..... 273/156, 153 S, 160; 446/92
See application file for complete search history.

(56) References Cited

U.S. PATENT DOCUMENTS 766,444 A * 8/1904 Hoy ..... A63F 9/12 273/160
1,546,024 A * 7/1925 Reichenbach ..... A63F 9/12 273/160
3,081,089 A * 3/1963 Gustafson ..... A63F 9/0838 273/153 S
3,117,384 A * 1/1964 Billis ..... G09B 19/02 273/157 R
4,441,715 A * 4/1984 Titus ..... A63F 9/0834 273/153 S
4,513,970 A * 4/1985 Opresco ..... A63F 9/34 273/153 S
4,865,323 A * 9/1989 Heusinkveld ..... A63F 9/0857 273/153 S
4,886,273 A * 12/1989 Unger ..... A63F 9/12 273/127 A
4,889,340 A * 12/1989 Greene ..... A63F 9/0098 273/153 S
5,127,652 A * 7/1992 Unger ..... A63F 9/0278 273/157 R
5,452,895 A * 9/1995 Ray ..... A63F 9/0857 273/153 S
5,826,873 A * 10/1998 Lavermicocca ..... A63F 9/12 273/157 R
5,895,044 A * 4/1999 Bahramian ..... A63F 9/1288 273/156

(Continued)

*Primary Examiner* — Gene Kim
*Assistant Examiner* — Matthew B Stanczak

(57) ABSTRACT

A spherical construction toy includes six segments consisting of a single outer convex surface and four inner concave surfaces, twelve segments consisting of a single outer convex surface, two inner convex surfaces, and two inner concave surfaces; and eight segments consisting of a single, outer convex surface and three inner convex surfaces. The segments are defined by the intersection of spherical surfaces having identical radius and disposed along Cartesian coordinate axes with the surface at the common center. The segments, when assembled in a base configuration with the outer surfaces disposed away from the common center, form a spherical assembly.

13 Claims, 17 Drawing Sheets

(56) References Cited

U.S. PATENT DOCUMENTS 6,017,220 A * 1/2000 Snelson ..... A63H 33/046 434/211
6,095,521 A * 8/2000 Patel ..... A63F 9/12 273/156
6,244,597 B1 * 6/2001 Matijek ..... A63F 9/0823 273/153 S
6,601,849 B1 * 8/2003 Konkle ..... A63F 9/12 273/156
6,652,347 B1 * 11/2003 Stevkovski ..... A63F 9/0838 434/211
6,769,690 B1 * 8/2004 Khoudary ..... B64G 1/641 273/153 S
6,805,350 B1 * 10/2004 Wu ..... A63B 43/00 273/156
6,834,451 B1 * 12/2004 Prost ..... G09F 19/00 273/153 S
7,108,263 B2 * 9/2006 Cabeza ..... A63F 9/0861 273/153 S
7,114,721 B2 * 10/2006 Micarelli ..... A63F 3/00 273/242
7,438,290 B2 * 10/2008 Yahyavi ..... A63F 9/0861 273/153 S
8,109,515 B2 * 2/2012 Fedoseyev ..... A63F 9/0861 273/153 R
8,141,876 B2 * 3/2012 Humphreys ..... A63H 33/108 273/156
2002/0115373 A1 * 8/2002 Lazerman ..... A63H 33/046 446/85
2002/0135125 A1 * 9/2002 Wu ..... A63F 9/12 273/156
2003/0209854 A1 * 11/2003 Chuang ..... A63F 9/1208 273/156
2005/0029735 A1 * 2/2005 Liu ..... A63F 9/12 273/156
2005/0248090 A1 * 11/2005 Anders ..... A63H 33/046 273/156
2005/0269770 A1 * 12/2005 Mak ..... A63F 9/0838 273/153 R
2006/0226600 A1 * 10/2006 Fang ..... A63F 7/042 273/153 S
2006/0234600 A1 * 10/2006 Pacheco ..... A63H 33/046 446/124
2008/0230989 A1 * 9/2008 Chen ..... A63F 9/0826 273/156
2009/0096161 A1 * 4/2009 Fedoseyev ..... A63F 9/0861 273/153 S
2010/0087119 A1 * 4/2010 Vicentelli ..... A63H 33/046 446/92
2010/0308536 A1 * 12/2010 Stolten ..... A63F 9/0838 273/153 R
2014/0232064 A1 * 8/2014 Marin ..... A63F 9/0861 273/153 S
2014/0300050 A1 * 10/2014 Stolten ..... A63F 9/0811 273/153 S
2014/0357151 A1 * 12/2014 Worley ..... A63H 33/046 446/92
2015/0079870 A1 * 3/2015 Howard ..... A63H 33/046 446/92
2015/0079872 A1 * 3/2015 Howard ..... A63H 33/046 446/92
2015/0283474 A1 * 10/2015 Howard ..... G09B 23/18 446/91
2016/0129361 A1 * 5/2016 Howard ..... A63H 33/04 446/92
2017/0266578 A1 * 9/2017 Apyshkov ..... A63H 33/26

* cited by examiner

THREE-DIMENSIONAL MAGNETIC CONSTRUCTION KIT-TOY

PRIORITY CLAIM

This application claims priority to U.S. Provisional Application No. 62/308,957 filed Mar. 16, 2016, the content of which is incorporated herein by reference.

TECHNICAL FIELD

The present disclosure is directed in general to magnetic construction toys and more particularly to magnetic structures allowing visualization of shapes formed by intersecting spheres.

BACKGROUND OF THE DISCLOSURE

Puzzle games and construction toys can be used for developing spatial thinking and spatial imagination of players or as educational visual aid when teaching combinatorial analysis, stereometry or other educational disciplines. In particular, while assisting with visualization of sections for spheroid (spherical) or obloid objects, it is useful to consider whether it is possible to break a ball into a finite number of equal parts in such a way that at least one of the parts does not contain the center of the ball on the border or inside.

SUMMARY OF THE DISCLOSURE

A spherical construction toy includes six segments consisting of a single outer convex surface and four inner concave surfaces, twelve segments consisting of a single outer convex surface, two inner convex surfaces, and two inner concave surfaces; and eight segments consisting of a single, outer convex surface and three inner convex surfaces. The segments are defined by the intersection of spherical surfaces having identical radius and disposed along Cartesian coordinate axes with the surface at the common center. The segments, when assembled in a base configuration with the outer surfaces disposed away from the common center, form a spherical assembly.

Although specific advantages have been enumerated above, various embodiments may include some, none, or all of the enumerated advantages. Additionally, other technical advantages may become readily apparent to one of ordinary skill in the art after review of the following figures and description.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1A:
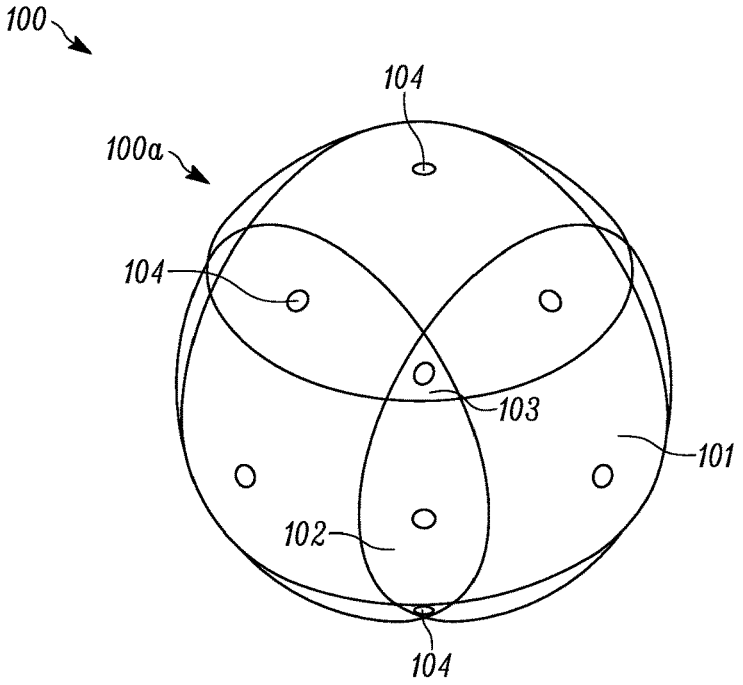
FIGS. 1A and 1B are a line drawing and a corresponding illustration, respectively, for a general perspective view of the three-dimensional magnetic construction kit-toy in the basic assembled ball form in accordance with an embodiment of the present disclosure.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below. Additionally, unless otherwise specifically noted, articles depicted in the drawings are not necessarily drawn to scale.

This present disclosure describes a three-dimensional magnetic construction kit toy which, when assembled in an "initial" of base state or configuration, forms a solid sphere. The spherical toy is composed of 26 segments (or "modular components") of three types. The pieces of the sphere are shaped as though the sphere were sliced apart by the surfaces of six other intersecting spheres with identical radiuses oriented relative to the original sphere to pass through from the top, bottom, left, right, front and back. The "planforms" (shape outlines as projected onto a plane) and cross-sections along different coordinate axes of different segments therefore differs. The spherical slicing planes all touch in the very center (origin) of the physical sphere when assembled in its initial or base round ball state. The resulting 26 sliced sections of the sphere provide modular construction elements that may be used to build various objects, or which may be used to assemble the primary spherical shape. Each of these modular components has magnets inset in each of their surfaces so that the pieces may easily adhere to one another in order to build objects, and may also be easily disconnected from one another to be reassembled to build yet more shapes.

A three-dimensional magnetic construction toy consists of 26 parts (or "segments" or "details") of the three types, with the surface of each part consisting of several fragments of spheres of the same radius. Each side of every detail has convex or concave surface. Each convex side of the detail can be combined with each concave side of other details. All details contain cylindrical magnets, with one of the sides of each magnet located on the surface of each piece of construction toy.

Such form of puzzle pieces is a result of visualization of the solution of the following mathematical problem, the formulation of which (for three dimensional case) sounds like: "Is it possible to break the ball on a finite number of equal parts in such a way that at least one of them does not contain the center of the ball on the border or inside?" The problem of the separation of the ball is partially solved. It turns out that ball can be divided on parts of three types and two types of them do not contain center of the ball within detail or on their boundary. Division into pieces was performed in the following way: An octahedron is inscribed in the original ball, with the points of contact of the ball and the inscribed octahedron being centers for new spheres of the same radius as the original ball. Intersections of some of the new spheres with the original were ensured to obtain details of all three types.

The shape of the construction kit toy embodiments is therefore developed through a visualization exercise that explores how a simple three-dimensional object, such as a sphere, might be elegantly separated into symmetrically-equal parts beyond merely slicing the sphere up along straight, flat planes. A conceptual formula created for this purpose may be expressed through the question: "Is it possible to slice apart a sphere into a finite number of symmetrical parts such that at least one of the sliced sections would not contain the center point of the sphere on the edge of the slice or within the slice?" In other words, could the sections be sliced apart in such a way that the center point might end up along one or more modular components' surfaces, instead of on an edge or inside of a single piece? The arrived-at solution provides an elegant method for geometrical sectioning of a sphere.

Figure 1B:
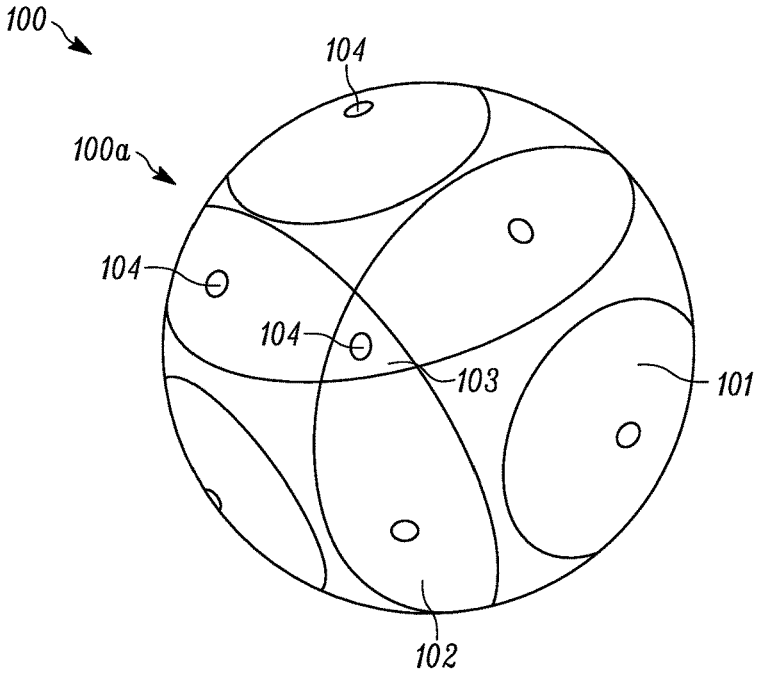

FIGS. 1A and 1B are a line drawing and a corresponding illustration, respectively, for a general perspective view of the three-dimensional magnetic construction kit-toy in the basic assembled ball form in accordance with an embodiment of the present disclosure. In the example of FIGS. 1A and 1B, the three-dimensional magnetic construction kit-toy 100 is a physical sphere 101*a* of a predetermined radius formed by a plurality of plastic segments 101, 102 and 103 held together by magnets 104. Segments 101, 102 and 103 may be formed of polylactic acid (PLA) or acrylonitrile-butadiene styrene (ABS) plastic, or polyamide nylon, and may be formed by molding or by three-dimensional (3D) printing. Magnets 104 are preferable relatively strong, cylindrical rare earth magnets inset within the segments 101, 102 and 103 in locations that align when the segments 101, 102 and 103 are assembled as shown in FIGS. 1A and 1B. Magnets 104 are preferably inset into convex surfaces with the north end flush with the respective surface and into concave surfaces with the south end flush with the respective surface.

The shapes of the segments 101, 102 and 103 are defined by the intersection, with the physical sphere 101*a*, of six additional imaginary spheres (shown in FIG. 1G) each having the same predetermined radius as the physical sphere 101*a*. The respective origin of each imaginary sphere is disposed along one of the six Cartesian coordinate axes (+x, −x, +y, −y, +z, and −z) from a central origin of the physical sphere 101*a*. The surface of each imaginary sphere is located at the origin of the physical sphere 101*a*.

Figure 1C:
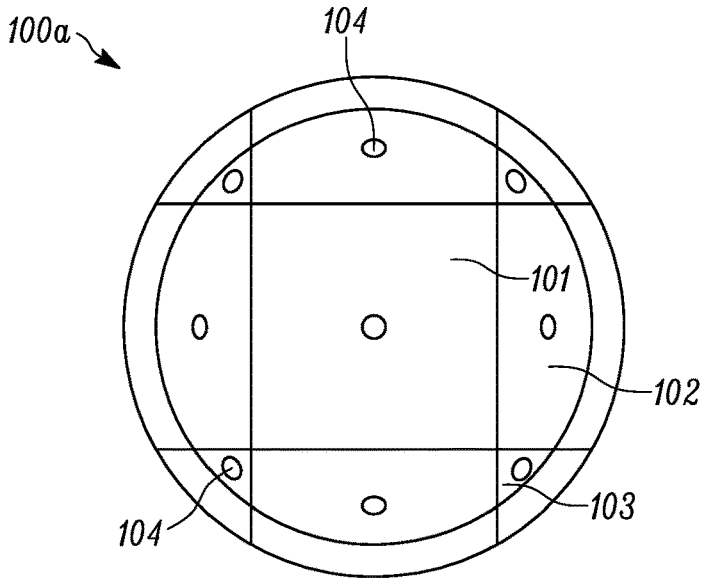
FIGS. 1C and 1D are line drawings.
Figure 1D:
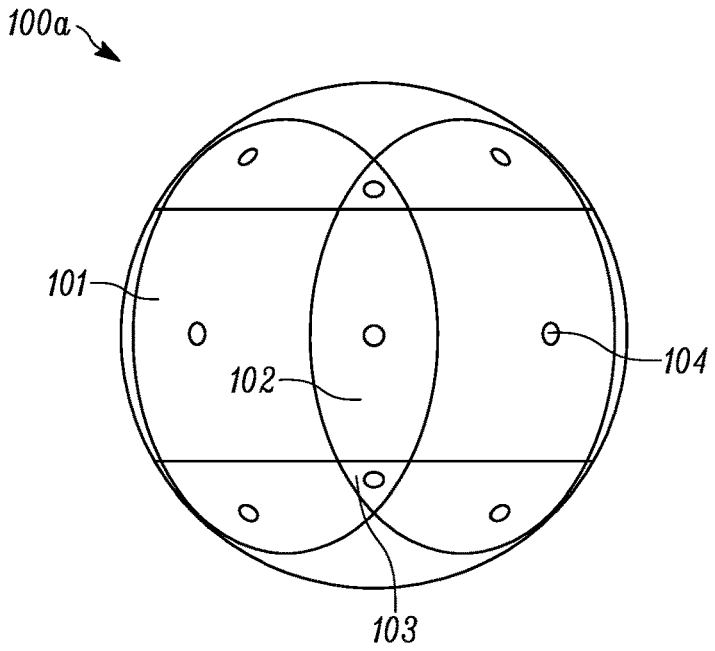
Figure 1E:
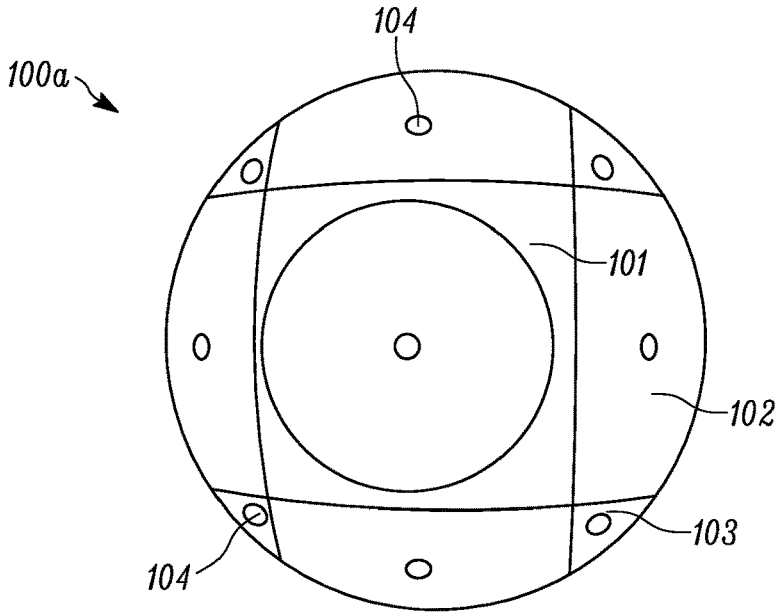
FIGS. 1E and 1F are corresponding illustrations, for perspective views of the three-dimensional magnetic construction kit-toy of FIGS. 1A and 1B.
Figure 1F:
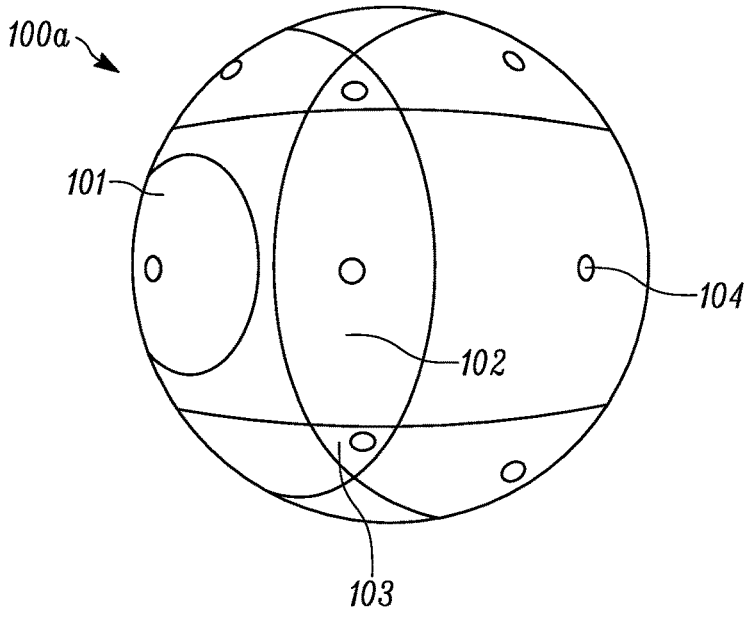
Figure 1G:
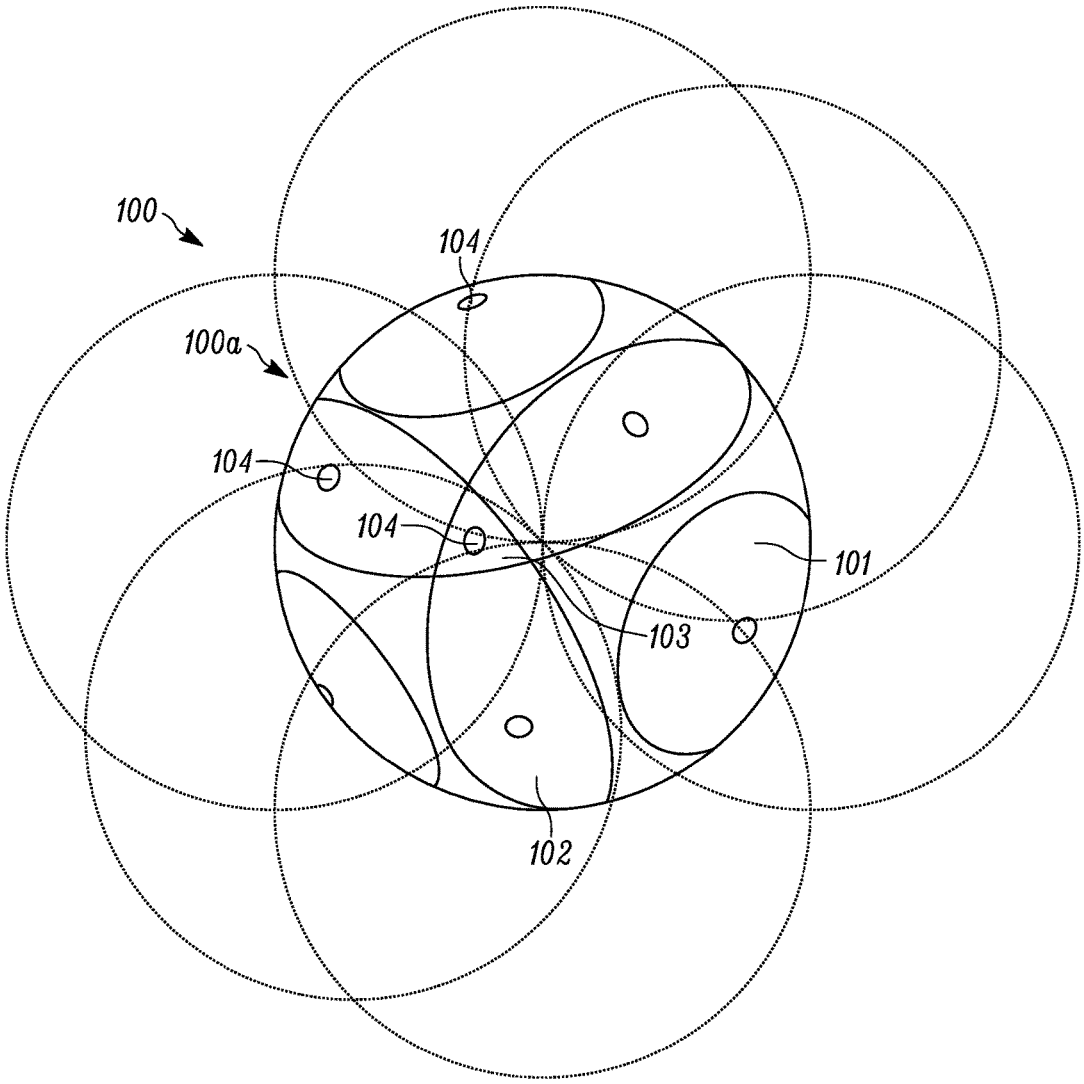
FIG. 1G is the illustration of FIG. 1B illustrating imaginary spheres intersecting to define the shape of the segments of the three-dimensional magnetic construction kit-toy in the basic assembled ball form in accordance with an embodiment of the present disclosure.

FIGS. 1C and 1D are line drawings, and FIGS. 1E and 1F are corresponding illustrations, for perspective views of the three-dimensional magnetic construction kit-toy 100 viewed from along one of the Cartesian coordinate axes (FIGS. 1C and 1E) and from within a plane containing four of the Cartesian coordinate axes, midway between two of those four axes (FIGS. 1D and 1F). The outer convex surfaces of segments 101, 102 and 103 are defined by circles inscribed on the surface of the physical sphere 101*a*. As seen in FIGS. 1C and 1E, six segments 101 of the physical sphere 101*a* each form a portion of the surface of the physical sphere 101*a* that appears square, with four apparently straight edges of equal lengths, when reduced to two dimensions. As seen in FIGS. 1D and 1F, twelve segments 102 each form a portion of the surface of the physical sphere 101*a* that appears generally rectangular when reduced to two dimensions, with two opposing shorter and apparently straight edges and two opposing longer and perceptibly convex edges. As seen in FIGS. 1A and 1B, eight segments 103 of the physical sphere 101*a* each form a portion of the surface of the physical sphere 101*a* that appears triangular, with three apparently straight edges of equal lengths, when reduced to two dimensions.

Figure 2A:
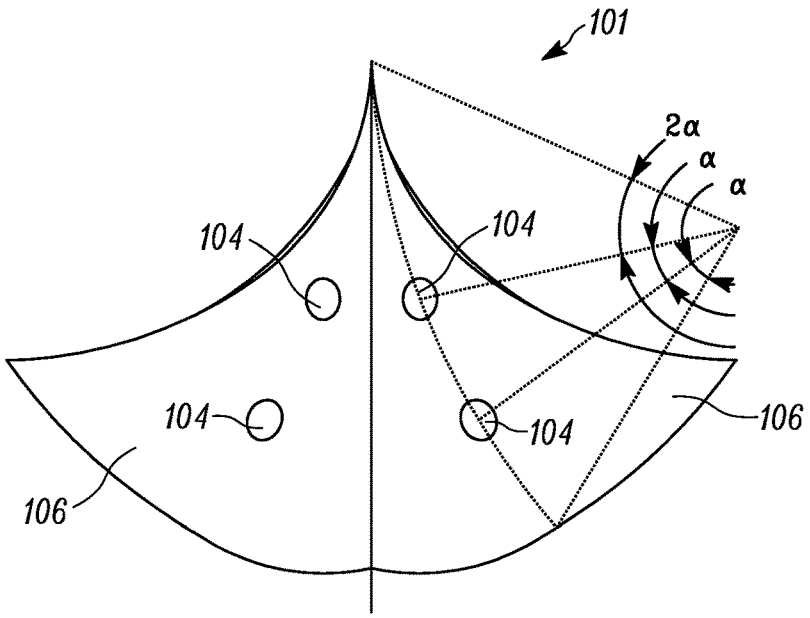
FIG. 2A is a line drawing for a perspective view of a first of the three types of segments forming the physical sphere of the three-dimensional magnetic construction kit-toy depicted in FIGS. 1A and 1B.
Figure 2B:
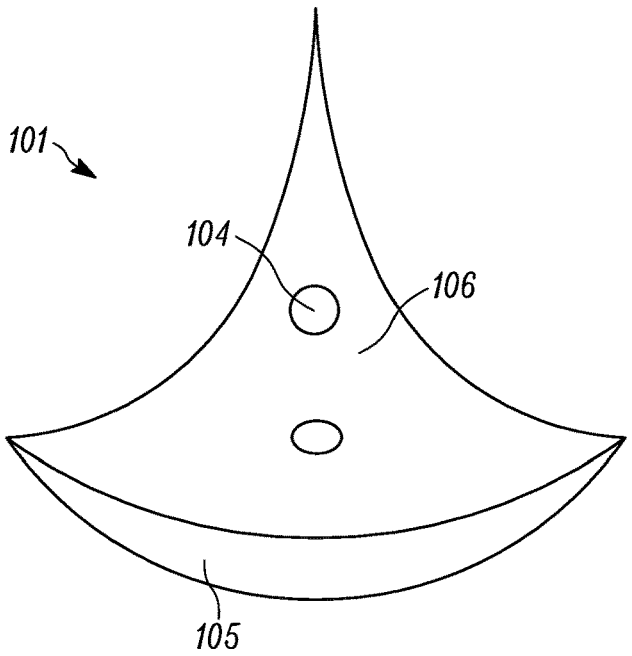
FIGS. 2B and 2C are elevation views and FIG. 2D is a plan view of the segment shown in FIG. 2A.
Figure 2C:
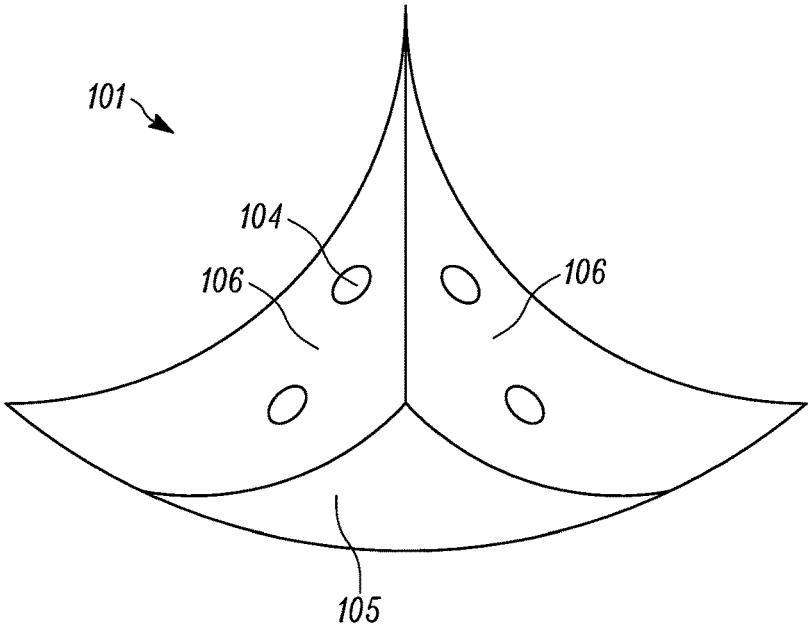
Figure 2D:
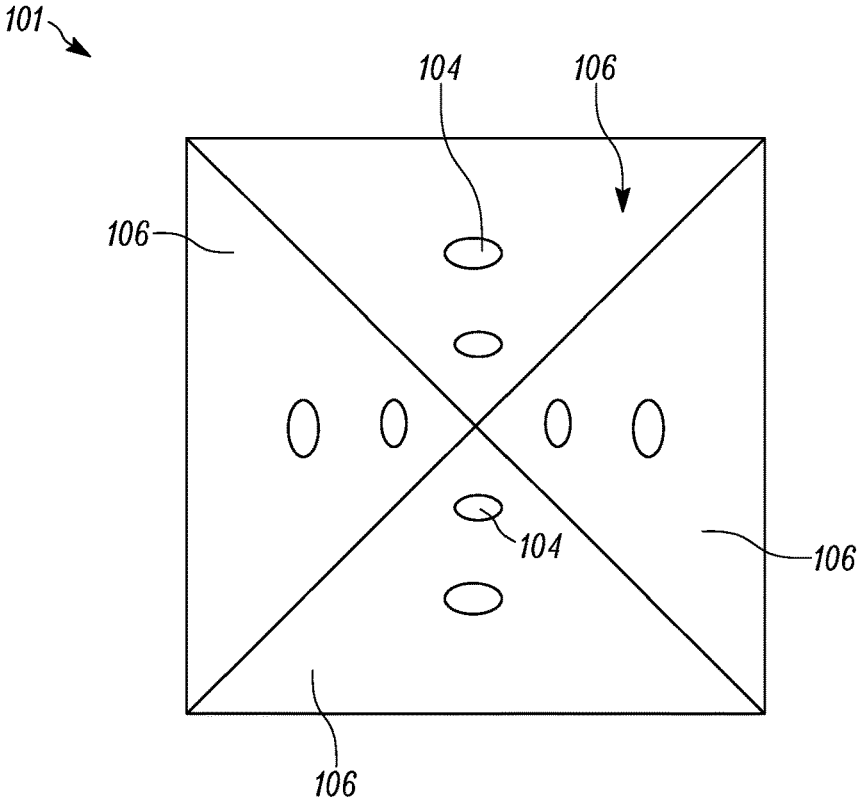
Figure 2E:
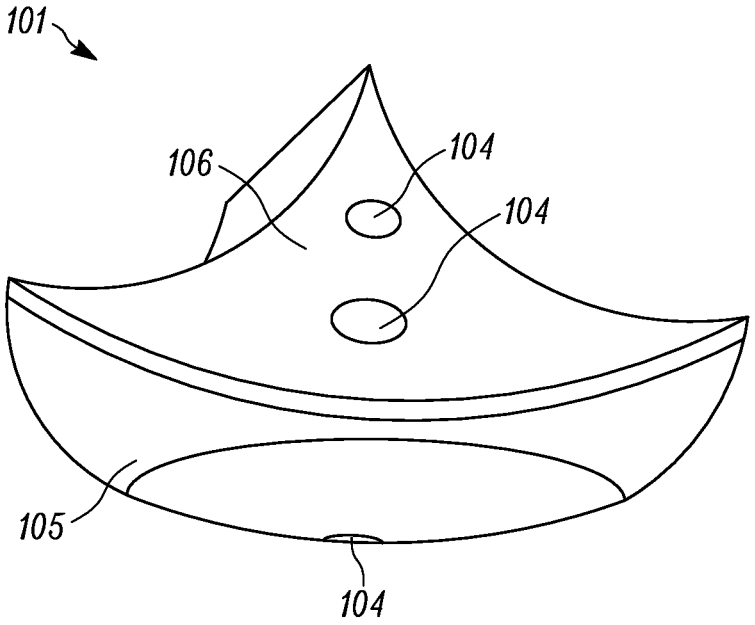
FIGS. 2E and 2F are perspective illustrations of the segment shown in FIG. 2A.
Figure 2F:
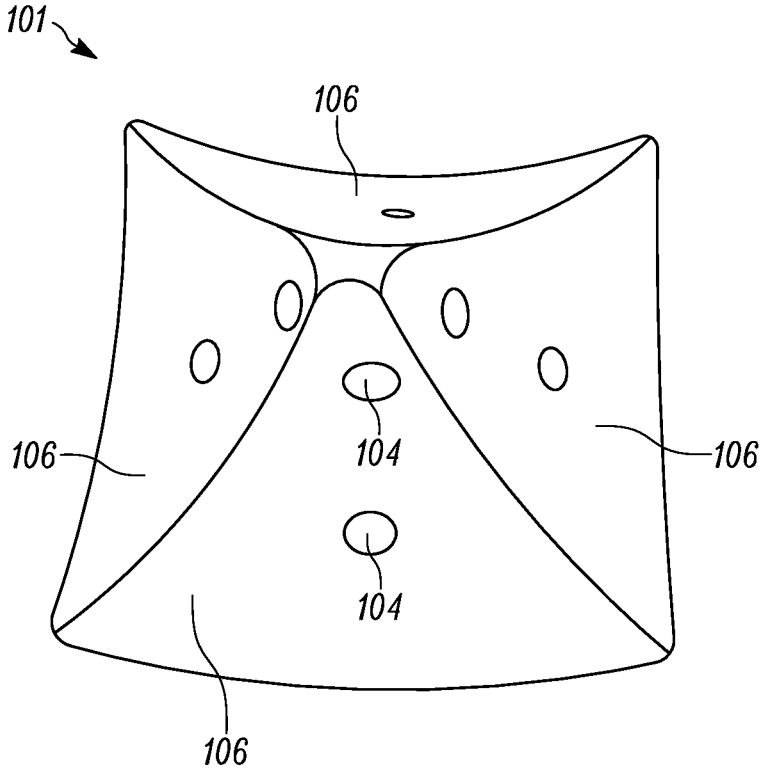

FIG. 2A is a line drawing for a perspective view of one of the types of segments forming the physical sphere of the three-dimensional magnetic construction kit-toy 100. FIGS. 2B and 2C are elevation views and FIG. 2D is a plan view of the segment shown in FIG. 2A, and FIGS. 2E and 2F are perspective illustrations of the segment shown in FIG. 2A. Segments 101 each comprise a convex surface 105 with a single magnet 104 inset in the center and four concave surfaces 106 each with two magnets 104. The convex outer surface 105 forms part of the outer surface of the physical sphere 101*a*, while the concave surfaces are internal to the physical sphere 101*a* when all 26 segments are assembled as shown in FIGS. 1A and 1B.

Figure 3A:
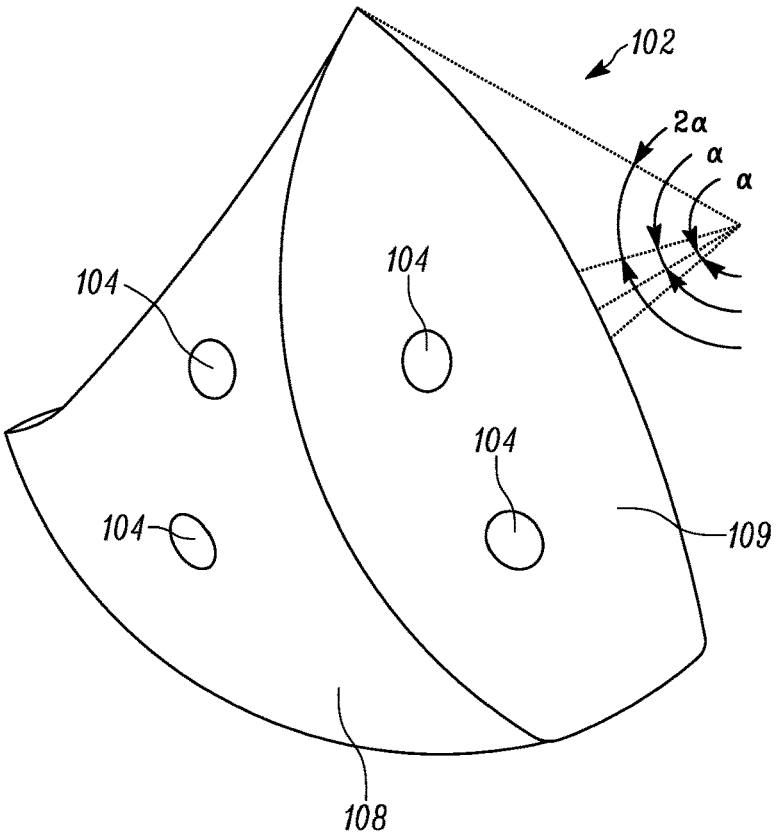
FIG. 3A is a line drawing for a perspective view of a second of the three types of segments forming the physical sphere of the three-dimensional magnetic construction kit-toy depicted in FIGS. 1A and 1B.
Figure 3B:
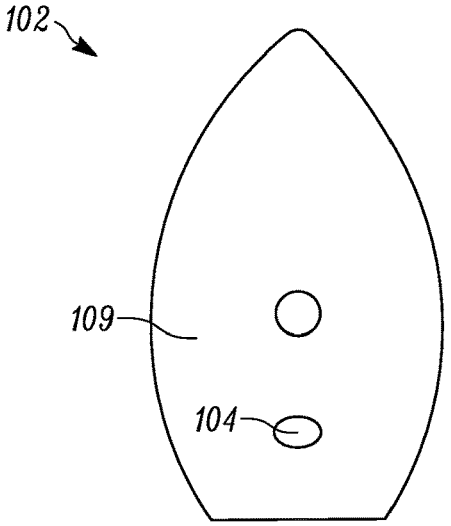
FIGS. 3B and 3C are elevation views and FIG. 3D is a plan view of the segment shown in FIG. 3A.
Figure 3C:
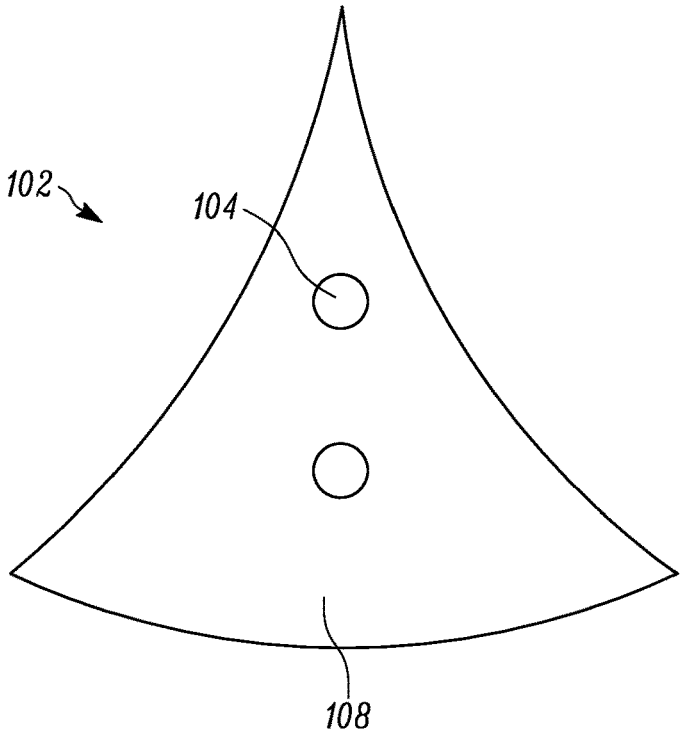
Figure 3D:
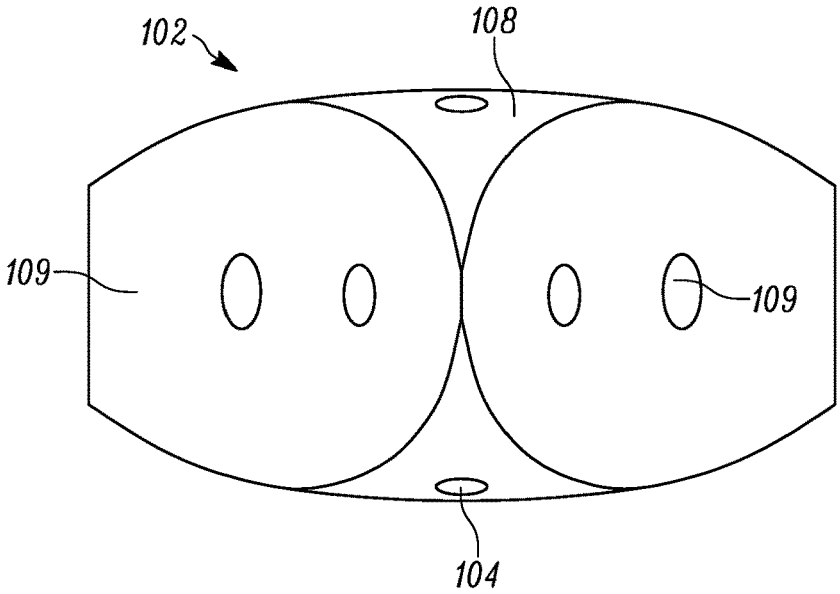
Figure 3E:
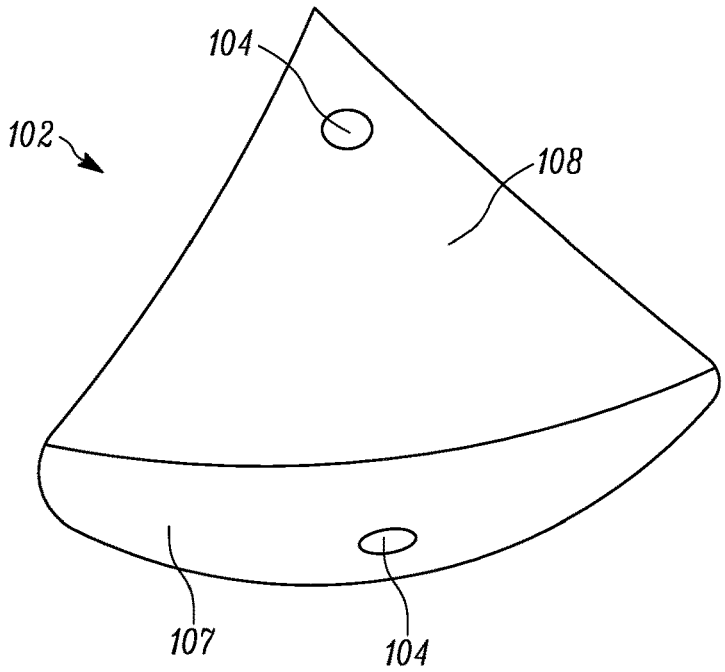
FIGS. 3E and 3F are perspective illustrations of the segment shown in FIG. 3A.
Figure 3F:
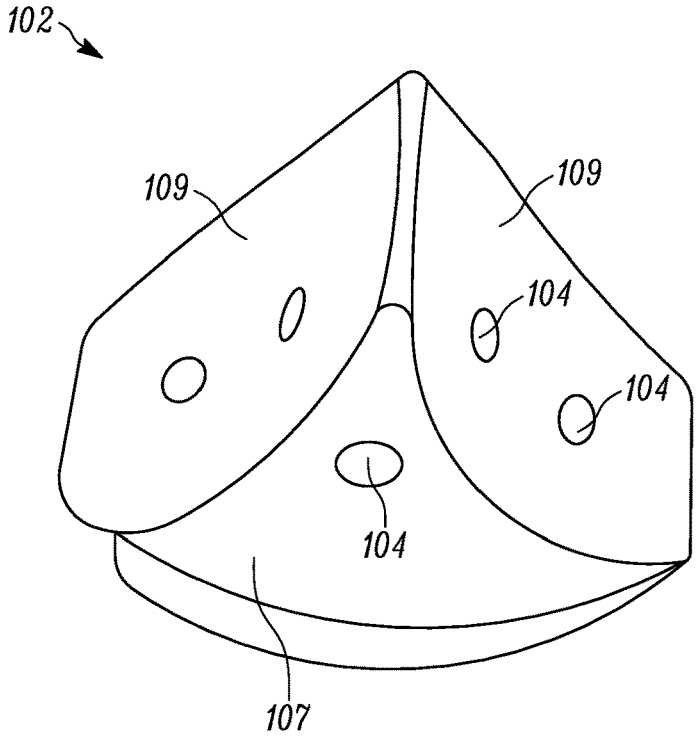

FIG. 3A is a line drawing for a perspective view of a second of the three types of segments forming the physical sphere of the three-dimensional magnetic construction kit-toy depicted in FIGS. 1A and 1B. FIGS. 3B and 3C are elevation views and FIG. 3D is a plan view of the segment shown in FIG. 3A. FIGS. 3E and 3F are perspective illustrations of the segment shown in FIG. 3A. Segments 102 each comprise a convex surface 107 forming part of the outer surface of the physical sphere 101*a* and having a single magnet 104 inset in the center. Segments 102 each have two opposing convex surfaces 108 and two opposing concave surfaces 109 that are internal to the physical sphere 101*a* when all 26 segments are assembled as shown in FIGS. 1A and 1B. Each convex surface 108 has a single inset magnet 104 and each concave surface 109 has two inset magnets 104.

Figure 4A:
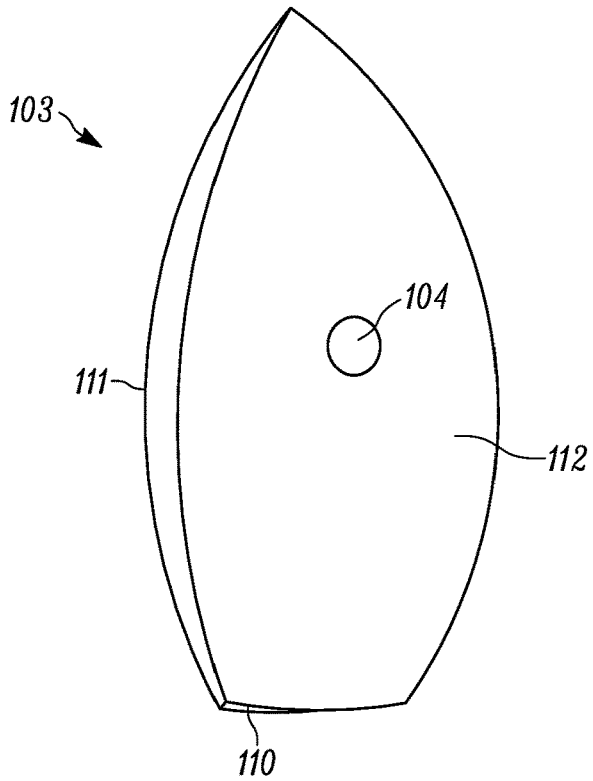
FIG. 4A is a line drawing for a perspective view of the third of the three types of segments forming the physical sphere of the three-dimensional magnetic construction kit-toy depicted in FIGS. 1A and 1B.
Figure 4B:
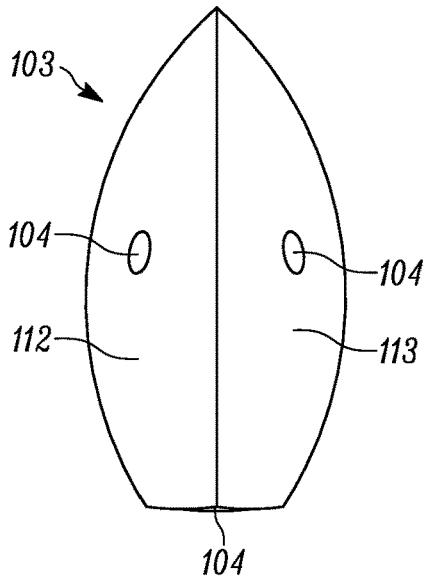
FIG. 4B is an elevation view and FIGS. 4C and 4D are end views of the segment shown in FIG. 4A.
Figure 4C:
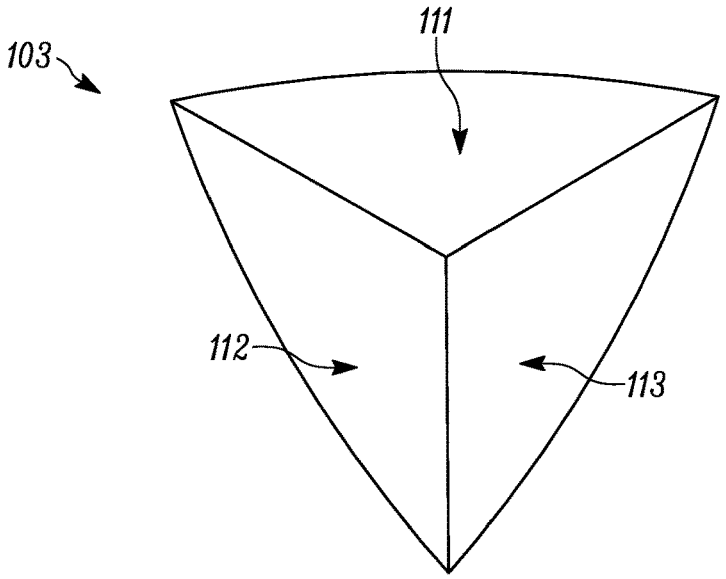
Figure 4D:
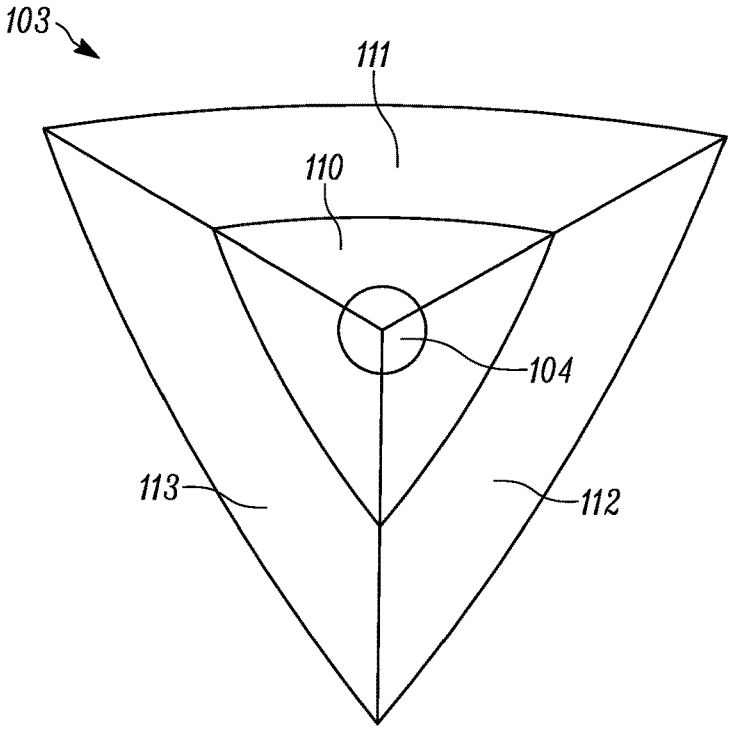
Figure 4E:
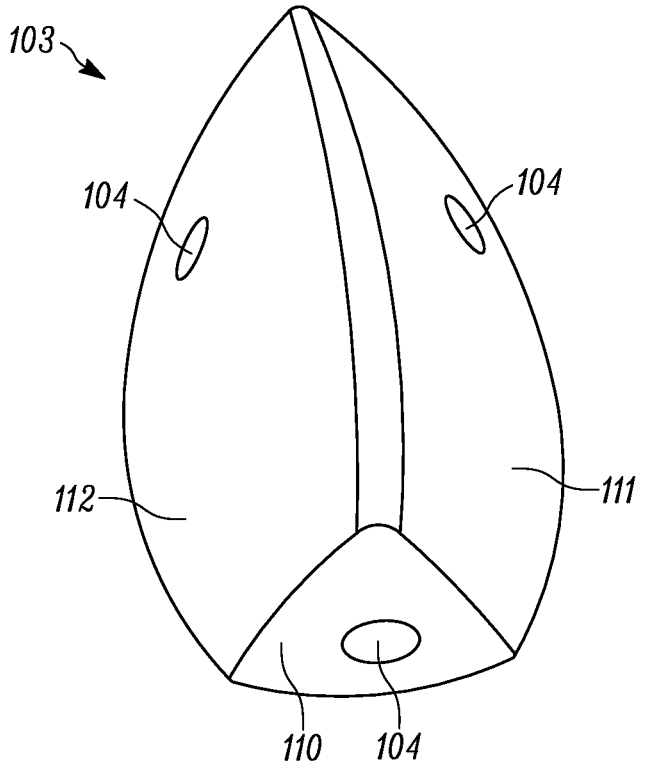
FIGS. 4E and 4F are perspective illustrations of the segment shown in FIG. 4A.
Figure 4F:
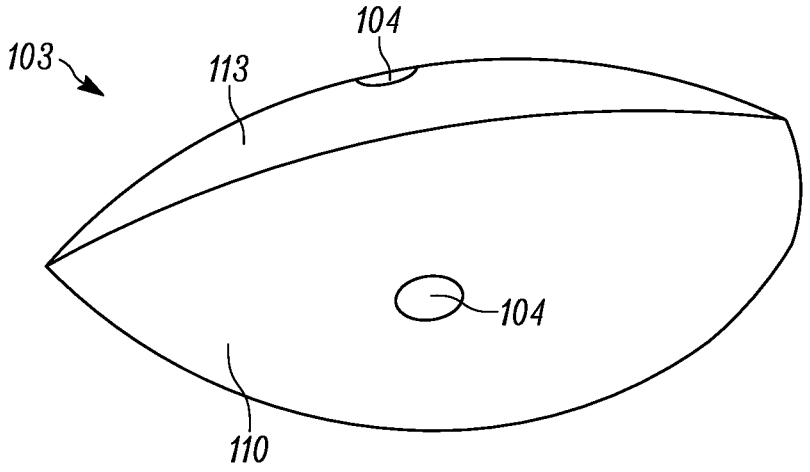

FIG. 4A is a line drawing for a perspective view of the third of the three types of segments forming the physical sphere of the three-dimensional magnetic construction kit-toy depicted in FIGS. 1A and 1B. FIG. 4B is an elevation view and FIGS. 4C and 4D are end views of the segment shown in FIG. 4A. FIGS. 4E and 4F are perspective illustrations of the segment shown in FIG. 4A. Segments 103 each comprise a triangular convex surface 110 forming part of the outer surface of the physical sphere 101*a* and having a single magnet 104 inset in the center. Segments 103 each have three elongate convex surfaces 111, 112, and 113 that are internal to the physical sphere 101*a* when all 26 segments are assembled as shown in FIGS. 1A and 1B. Each convex surface 111, 112 and 113 has a single inset magnet 104.

Figure 5A:
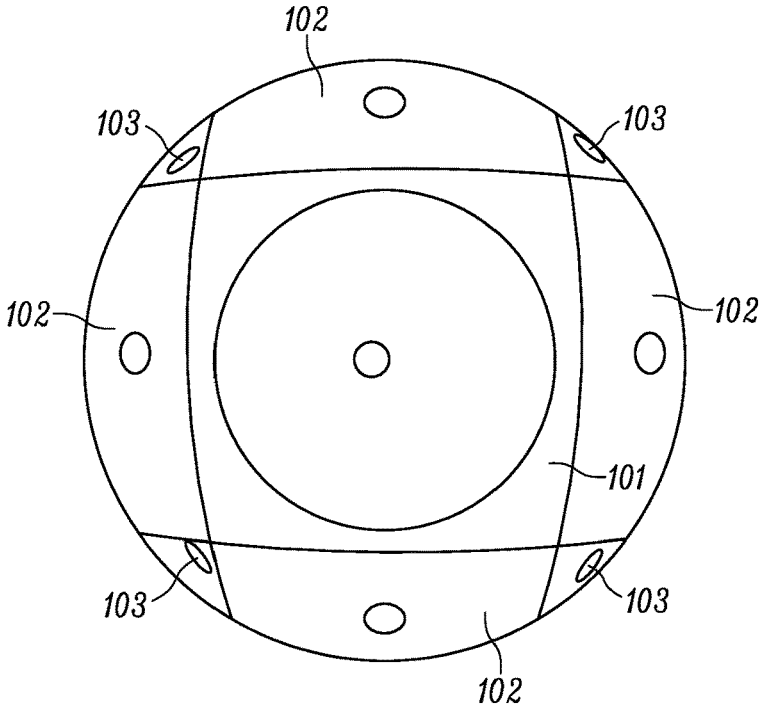
FIGS. 5A and 5B are illustrations of the top and bottom views for a polar subassembly of the physical sphere of the three-dimensional magnetic construction kit-toy depicted in FIGS. 1A and 1B.
Figure 5B:
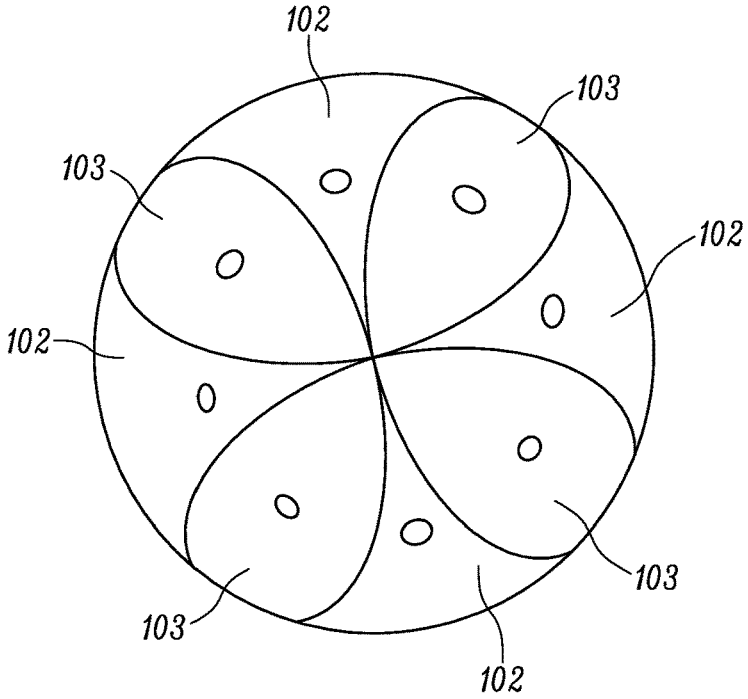
Figure 5C:
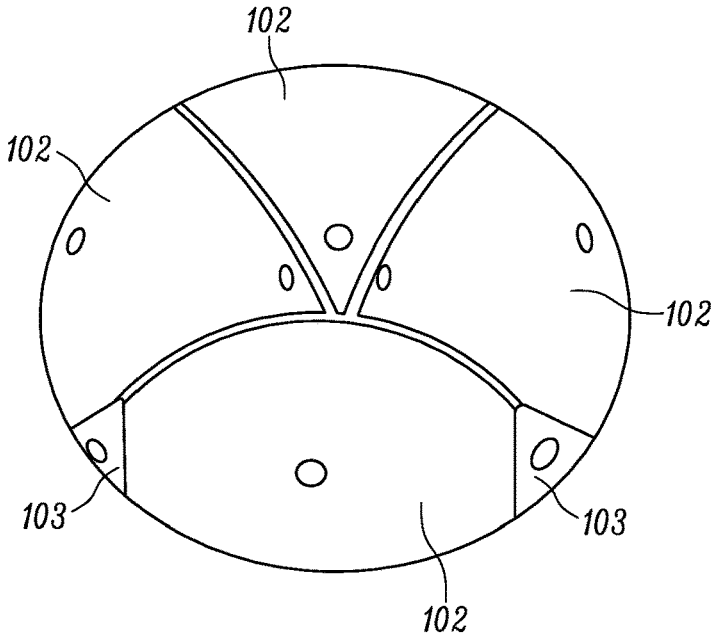
FIG. 5C is an illustration of the top view for a polar subassembly of FIGS. 5A and 5B with the first type of segment removed.
Figure 6A:
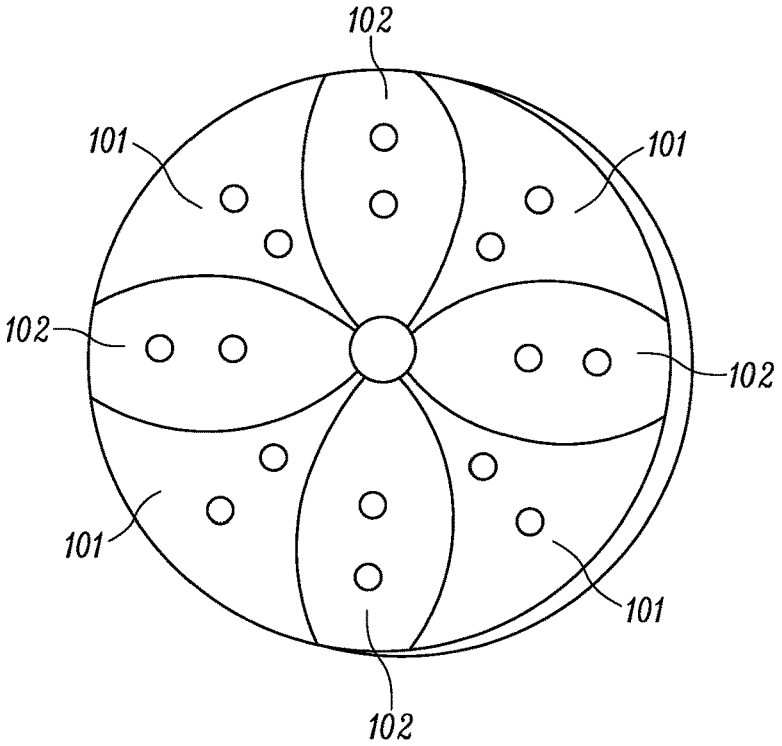
FIGS. 6A, 6B and 6C are illustrations of the end and side views for an equatorial subassembly of the physical sphere of the three-dimensional magnetic construction kit-toy depicted in FIGS. 1A and 1B.
Figure 6B:
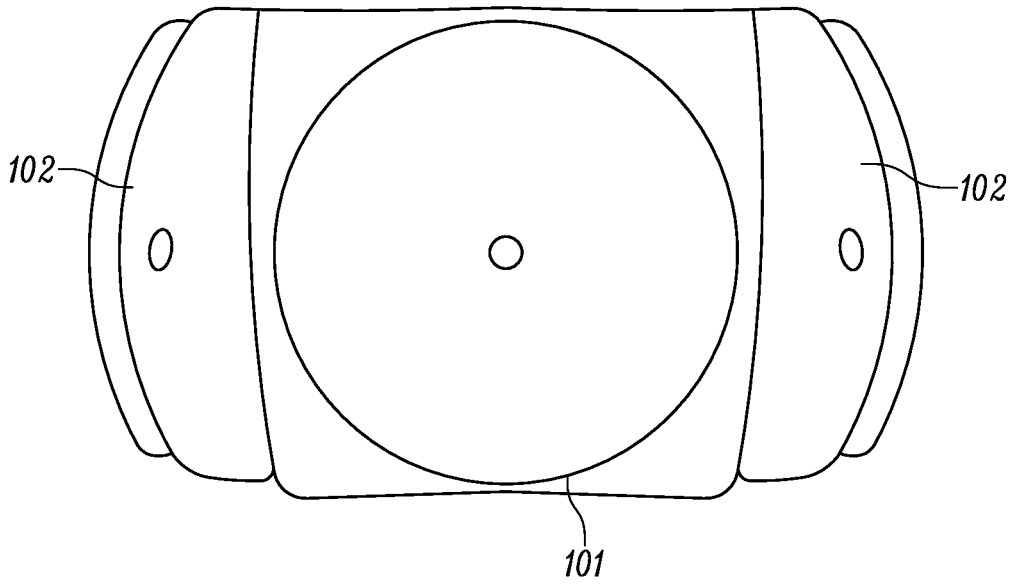
Figure 6C:
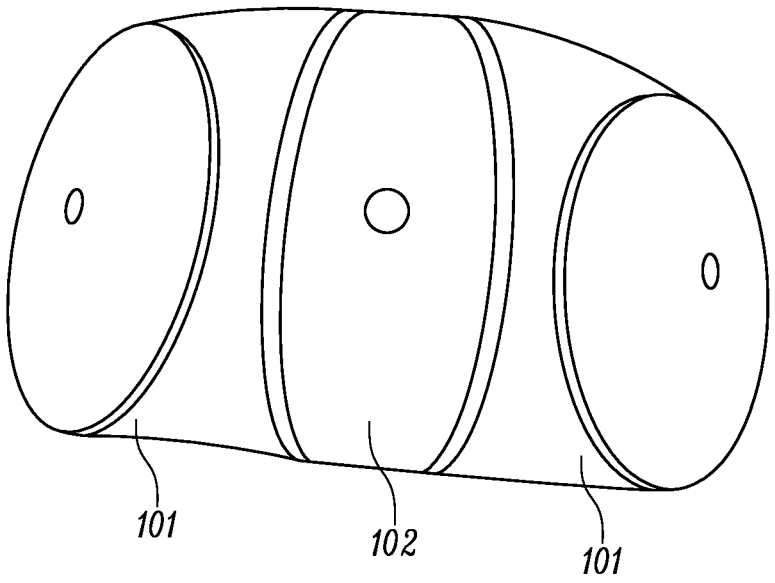

FIGS. 5A and 5B are illustrations of the top and bottom views for a polar subassembly of the physical sphere of the three-dimensional magnetic construction kit-toy depicted in FIGS. 1A and 1B. FIG. 5C is an illustration of the top view for a polar subassembly of FIGS. 5A and 5B with the first type of segment removed. FIGS. 6A, 6B and 6C are illustrations of the end and side views for an equatorial subassembly of the physical sphere of the three-dimensional magnetic construction kit-toy depicted in FIGS. 1A and 1B. The physical sphere 101*a* may be segmented into identical two polar subassemblies and a single equatorial subassembly. Each polar subassembly, shown in FIGS. 5A and 5B, comprises one segment 101, four segments 102 and four segments 103. The outer surface 105 of segment 101, the outer surfaces 107 of each segment 102, and the outer surfaces 110 of each segment 103 form the top surface of each polar subassembly. No surface of segment 101 forms any part of the bottom surface of each polar subassembly. The bottom surface of each polar subassembly is formed from the inner convex surfaces 108 of segments 102 and the inner convex surfaces 111 (or 112, or 113) of segments 103. The equatorial subassembly, shown in FIGS. 6A, 6B and 6C, has two opposing surfaces and a circumferential surface. The opposing surfaces are each formed by the inner, concave surfaces of segments 101 and 102, alternating around a center. The circumferential surface of the equatorial subassembly is formed by the outer, convex surfaces of alternating segments 101 and 102.

Figure 7A:
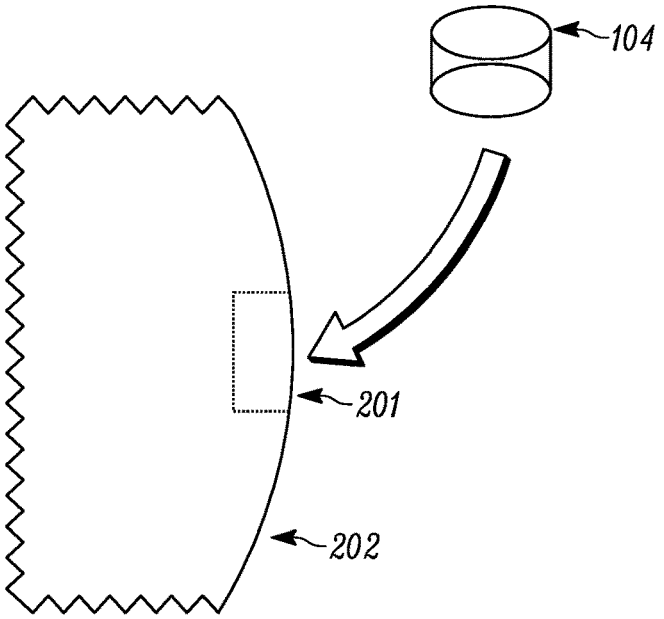
FIGS. 7A and 7B are sectional views illustrating insertion of cylinder magnets inset into convex and concave surfaces of the segments for the physical sphere of the three-dimensional magnetic construction kit-toy depicted in FIGS. 1A and 1B.
Figure 7B:
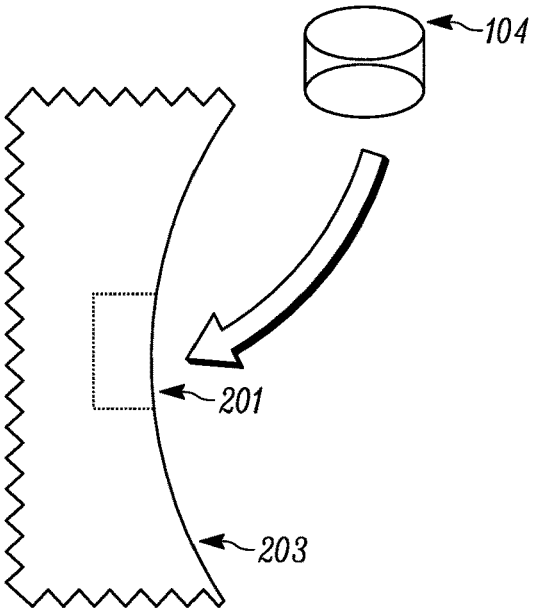

FIGS. 7A and 7B are sectional views illustrating insertion of cylinder magnets inset into convex and concave surfaces of the segments for the physical sphere of the three-dimensional magnetic construction kit-toy depicted in FIGS. 1A and 1B. Each convex surface 202 of any segment 101, 102 or 103, and also each concave surface 203 of any segment 101, 102 or 103, is provided with a hole 201 in the respective segment body. Each hole 201 has a diameter d and height h equal to the corresponding dimensions of substantially uniform rare earth magnets 104. The holes 201 may be formed, for example, by drilling. The rare earth magnets are inserted into the holes 201 with one polar face (e.g., north) facing outward from the respective segment body and flush with convex segment surfaces 202 and the opposite polar face (e.g., south) facing outward from the respective segment body and flush with concave segment surfaces 203. The magnets 104 are retained in the holes 201 by friction fit or, alternatively, by a suitable adhesive. Each concave surface 203 may therefore be placed against any convex surface 202 and retained in position by attraction of the corresponding magnets inset into the segment bodies. The convex and concave surfaces 202 and 203 and surfaces of equal but opposite curvature, and thus "fit" together.

A working principle of the present disclosure is that, due to the selection of the positions and orientations of the magnets within the segment bodies and the shape of segment bodies (or "details," or game "piece"), any convex side of each piece can be combined with any concave side of any other piece. Thus, there are over 10,000 different unique combinations that can be assembled using either all 26 segments or only some of them.

One application of the structure described in the present disclosure is as a toy that can be used as an educational visual aid for school children when teaching combinatorial analysis, stereometry or other educational disciplines. The three-dimensional magnetic construction toy can also be decoration or architectural visual aid. The 26 segments described above may therefore be considered game playing elements or pieces of three different types: the first type 101; the second type 102; and the third type 103. Surfaces of each game element 101, 102 or 103 of the first, second and third type, respectively, consist of several fragments of a spherical surface for intersecting spheres of the same radius. As a result, some surfaces (or "sides") of the details are convex and others are concave. Some game elements have only convex surfaces (e.g., segments 103), while others have both convex and concave surfaces.

Mathematically, the segments 101, 102 and 103 may be defined as follows: Assume that three Cartesian coordinate axes x, y, and z are defined as having an origin corresponding to the center or focal point of the physical sphere 101*a*. The segments 101 or game playing elements of the first type can be obtained as follows:

from the lower hemisphere with the center in the (0,0,0) and with the radius R, discard parts that together intersecting with 4 spheres of radius R centered at (R,0,0), (−R,0,0), (0,R,0) and (0,−R,0); and after discarding those portions, the remainder of the initial hemisphere will be the segment 101 or game playing element of the first type.

The segments 102 or game play elements of the second type can be obtained as follows:

from a piece that is at the intersection of a hemisphere with center (0,0,0) and two spheres of radius R with centered at (−R,0,0) and (0,0,−R), discard parts other than the overlap with the sphere of radius R and centered at (0,R,0);

after discarding those portions, from the remaining part, discard the intersection with the sphere of radius R and centered at (0,−R,0); and after discarding those portions, the remainder of the initial hemisphere will be the segment 101 or the game playing element of the second type.

The segments 103 or game play elements of the third type can be obtained as follows:

intersect a hemisphere with center (0,0,0) with three spheres of radius R with centers (0,R,0), (0,0,−R), and (−R,0,0); and the resulting volume of this intersection is the segment 103 or game playing element of the third type.

Taken together, the game playing elements represent forms that are fragments of spheres with surfaces that result from the intersection of several spherical surfaces. In all parts of three-dimensional magnetic construction toy, polar cylindrical magnets of the same type and the same size are firmly fixed in every piece of the construction toy by the friction force. The general location of the magnet in the socket or hole 201 for arbitrary convex surface 202 or concave surface 203 of each puzzle or construction toy piece is with one pole disposed outside on each convex surface and with another pole disposed outside on each concave surface. This arrangement of magnets, based on the poles, allows each convex surface to be combined with each concave surface. Magnets are fixed firmly enough that they are not extracted from their seats during use of magnetic construction toy. The magnets in the game playing elements of the first, second and third types can alternatively be situated in another way or the numbers of magnets can be less or more than shown and described herein. Due to variety of magnet numbers, the quantity of symmetric configurations can be changed.

The diameter of a working prototype of the physical sphere 101*a* in assembled form is 80 millimeters (mm). The size of cylinder magnets is d=3.2 mm and h=1.6 mm. However, the construction toy may be formed with smaller or larger diameter and with magnet size likewise also smaller or larger, preferably according to the size changes of the game playing elements. The surfaces of each piece of the three-dimensional magnetic construction toy have smooth, rounded edges with, for an 80 mm diameter construction toy, a radius of fillet equal to 1 millimeter. All elements of the construction toy can be cast from polymers using the existing industrial equipment.

The description in the present application should not be read as implying that any particular element, step, or function is an essential or critical element which must be included in the claim scope: the scope of patented subject matter is defined only by the allowed claims. Moreover, none of these claims are intended to invoke 35 USC § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," or "controller" within a claim is understood and intended to refer to structures known to those skilled in the relevant art, as further modified or enhanced by the features of the claims themselves, and is not intended to invoke 35 U.S.C. § 112(f).

What is claimed is:

1. An apparatus, comprising:

a plurality of first segments, each first segment having a single outer convex surface and four inner concave surfaces;

a plurality of second segments, each second segment having a single outer convex surface, two inner convex surfaces, and two inner concave surfaces;

a plurality of third segments, each third segment having a single outer convex surface and three inner convex surfaces; and magnets inset into the first, second and third segments to retain contacting surfaces of the first, second and third segments in contact, wherein the first, second and third segments, when assembled in a first configuration with the outer surfaces disposed away from a common center, form a spherical assembly, and wherein, when the first, second and third segments are assembled in the first configuration, the outer surfaces of the first, second and third segments form an outer surface of the spherical assembly and the inner surfaces of the first, second and third segments are internal to the spherical assembly.

2. The apparatus according to claim 1, wherein the magnets are inset into convex surfaces of the first, second and third segments with a first pole exposed and are inset into concave surfaces of the first, second and third segments with a second pole exposed.

3. The apparatus according to claim 1, wherein the single outer convex surface of each of the first segments has a square planform.

4. The apparatus according to claim 1, wherein the single outer convex surface of each of the second segments has a rectangular planform with convex long sides.

5. The apparatus according to claim 1, wherein the single outer convex surface of each of the third segments has a triangular planform.

6. The apparatus according to claim 1, wherein every surface of the first, second and third segments has an identical radius of curvature.

7. An apparatus, comprising:

a plastic sphere of radius R formed by a plurality of plastic segments, each of the plastic segments having a shape defined by an intersection, with the plastic sphere, of six imaginary spheres, each imaginary sphere having a radius R and centered, relative to a Cartesian coordinate origin (0,0,0) of the plastic sphere, at (R,0,0), (0,R,0), (0,0,R), (−R,0,0), (0,−R,0), and (0,0,−R), and a radius of fillet for each edge of each of the plastic segments.

8. The apparatus according to claim 7, wherein the plastic segments include:

six segments having a single outer convex surface and four inner concave surfaces, twelve segments having a single outer convex surface, two inner convex surfaces, and two inner concave surfaces, and eight segments having a single outer convex surface and three inner convex surfaces.

9. The apparatus according to claim 8, wherein the single outer convex surface of each of the six segments has a square planform, wherein the single outer convex surface of each of the twelve segments has a rectangular planform with convex long sides, and wherein the single outer convex surface of each of the eight segments has a triangular planform.

10. The apparatus according to claim 7, further comprising magnets inset into the plastic segments to retain contacting surfaces of the plastic segments in contact, wherein the magnets are inset into convex surfaces of the plastic segments with a first pole exposed and are inset into concave surfaces of the plastic segments with a second pole exposed.

11. The apparatus according to claim 10, wherein the magnets are inset into surfaces of the plastic segments to retain any concave surface of one of the plastic segments in contact with a convex surface of another of the plastic segments.

12. The apparatus according to claim 10, wherein two or more of the plastic segments may be placed into contact with each other and retained in contact by the magnets to form alternative structures other than the plastic sphere, the alternative structures including at least:

a polar subassembly comprising one of the six plastic segments, four of the twelve plastic segments, and four of the eight plastic segments, and an equatorial subassembly comprising four of the six plastic segments and four of the twelve plastic segments.

13. The apparatus according to claim 7, wherein the radius R is 80 millimeters (mm) and the radius of fillet for every edge of the plastic segments is 1 mm.

* * * * *